United States Patent [19]

Baus

[11] Patent Number: 4,651,720

[45] Date of Patent: Mar. 24, 1987

[54] MASSAGING AND SHOWERING ASSEMBLY

[76] Inventor: Heinz G. Baus, Wartbodenstrasse 35, Hünibach-Thun, Switzerland

[21] Appl. No.: 480,669

[22] Filed: Mar. 31, 1983

[30] Foreign Application Priority Data

Apr. 2, 1982 [DE] Fed. Rep. of Germany ..... 3212298

[51] Int. Cl.[4] ..... A61H 9/00; A61H 23/04

[52] U.S. Cl. ..... 128/38; 4/614; 128/53; 128/66

[58] Field of Search ..... 128/52, 56, 65, 66, 128/50, 53; D23/35; 4/614, 604; 15/21 R

[56] References Cited

U.S. PATENT DOCUMENTS

| | | | |
|---|---|---|---|
| D. 217,548 | 5/1970 | Niemann | D23/35 |
| 1,982,509 | 11/1934 | Frank | 128/66 |
| 2,697,839 | 12/1954 | Jackson | 4/145 |
| 2,730,737 | 1/1956 | Herman | 128/56 |
| 3,047,239 | 7/1962 | Canavan | D23/35 |
| 3,078,843 | 2/1963 | Brisson | 128/65 |
| 3,616,466 | 11/1971 | Davis | D23/35 |
| 3,768,462 | 10/1973 | Boulard | 128/65 |
| 4,274,400 | 6/1981 | Baus | 128/65 |
| 4,457,031 | 7/1984 | Moore | 4/614 |

FOREIGN PATENT DOCUMENTS

| | | | |
|---|---|---|---|
| 2357529 | 5/1975 | Fed. Rep. of Germany . | |
| 2429808 | 1/1976 | Fed. Rep. of Germany . | |
| 2646039 | 4/1978 | Fed. Rep. of Germany . | |
| 2707622 | 8/1978 | Fed. Rep. of Germany | 4/614 |
| 2746705 | 4/1979 | Fed. Rep. of Germany | 128/52 |
| 2197395 | 3/1974 | France . | |

OTHER PUBLICATIONS

House; House Beautiful; Oct. 1964; p. 216.

*Primary Examiner*—Clyde I. Coughenour

*Attorney, Agent, or Firm*—Schwartz, Jeffery, Schwaab, Mack, Blumenthal & Evans

[57] ABSTRACT

A massaging and showering assembly comprising a guide rail along which a carriage holding a massage and shower head can be moved vertically; a water flow reversing control-unit and a piston-cylinder arrangement which is connected to a water line and with which the carriage is in communication. Known assemblies of this kind have been of costly and generally heavy design, the guide rail, in particular being freely accessible and highly exposed to dirt and damage. They also occupy a relatively large space and are very difficult to install in shower cabins. In contrast to this, the assembly of the present invention is to be produced at low production cost, to be light and compact, but to be highly reliable and while having great stability. This new assembly provides a carriage guiding rail with an inner chamber for the piston-cylinder arrangement, the inner chamber comprising a closing front wall. Moreover, the carriage-guiding rail is provided, behind the front wall, with an opening for a guide element for the carriage.

7 Claims, 11 Drawing Figures

MASSAGING AND SHOWERING ASSEMBLY

BACKGROUND OF THE INVENTION

1. Field of the Invention

The present invention relates to a massaging and showering assembly comprising a guide rail along which a carriage for a massage and shower head can be moved vertically back and forth, with a water flow reversing control unit and a piston-cylinder arrangement which is adapted to be connected to a water line, and with which the said carriage is in communication.

2. Description of the Prior Art

An assembly of this type is described in U.S. Pat. No. 3,768,462 granted on Oct. 30, 1973. This known assembly comprises two upright cylinders spaced from each other, one of the said cylinders containing a piston which communicates, through a cable or the like, with the carriage. The cylinder has a chamber on each side of the piston, to which water pressure may be applied, selectively. Also provided is a reversing control-unit with a control slide valve by means of which the water line may be connected selectively to one or the other of the cylinder chambers. The guide means for the carriage is freely accessible, so that lime deposits and other forms of deposits may easily interfere with the operation of the assembly. Furthermore, the cable, the switch bar which actuates the control slide valve, and the water hoses are all freely accessible and visible, and this is not only detrimental to the overall esthetic impression, but may also cause contamination, jamming and the like to interfere with safe operation.

SUMMARY OF THE INVENTION

Starting from a massaging and showering assembly of this kind, it is an object of the present invention to improve the assembly at low expenditure and production costs, in a such a manner as to combine simple design with high operating reliability and, more particularly, largely eliminate the danger of contamination of, or damage to, the carriage guiding rail. The assembly possesses great stability, little structural depth, and a long service life. It also meets all safety requirements and is easy to service. Finally it is reliable in operation and able to withstand operational and use requirements.

According to the invention, this object is accomplished in that a sectional guiding rail is provided having an inner chamber in which a piston cylinder arrangement is mounted; in that the inner chamber is closed at the front by a wall; and in that the carriage guiding rail comprises an aperture, behind the front wall, extending in the longitudinal vertical direction, for the guiding of a guide element of the carriage.

The assembly according to the invention is of simple design ensuring great operating reliability and long service life. The piston-cylinder unit in the interior of the sectional guiding rail is largely protected from external effects, the inner chamber being reliably closed off by a wall at the front. The cylinder may therefore have a thin wall and may possibly be made of plastic, thus substantially reducing the overall weight and structural volume. Since the carriage guiding rail is also arranged behind the front wall, the danger of contamination and interference with the movement of the carriage is largely eliminated.

According to one desirable embodiment, the sectional guiding rail comprises a transverse wall and the piston-cylinder arrangement is located between the transverse wall and the front wall. The transverse wall preferably comprises an approximately semi-cylindrical recess for the accommodation of the cylinder. On the one hand, the transverse wall greatly increases the rigidity of the sectional rail while, on the other hand, it permits simple attachment of the piston-cylinder arrangement, the adjusting cock, and other components.

In order to make the said components, including the piston-cylinder arrangement, easily accessible, the front wall, in one particular variant, is detachable from the sectional rail. It should be pointed out, at this time, that the front wall may be made in one piece with the sectional rail and/or the guide cylinders. However, the detachability of the front wall makes the said components particularly easy of access. On the one hand, this greatly facilitates production and assembly of the invention and, on the other hand, maintenance work may be carried out with little effort, the assembly remaining completely installed and only the front wall being removed to provide easy access to the different components. Another important aspect is that the front wall may easily be adapted to colour, form and other requirements, leaving the assembly otherwise unchanged. This provides cost advantages in both production and storage, for instance a dealer may meet his customers' requirements by stocking a variety of front walls. The front wall may also be made as a sectional rail, detachably secured, in a suitable manner, to the sectional rail and/or to the guide rail.

In one preferred embodiment, the front wall has rearwardly rounded lateral edges engaging at least partly around the front corners of the sectional rail and/or the guiding cylinders. The front wall may, if necessary, be provided with catches, or the like, acting as snap-fasteners and allowing the front wall to be fitted or removed without the use of special tools.

According to a particular embodiment, a guide rail is provided in the vicinity of each front corner of the sectional rail, the said guide rail having a substantially cylindrical external and/or internal contour. The sectional rail and the guide rails are made in one piece, the approximately cylindrical external surfaces of the guide rails serving simultaneously for the support and attachment of the front wall. Thus the inner chamber, accommodating the piston-cylinder unit and other components, is defined laterally by the guide rails, resulting in an overall structure which is not only highly compact but is still stable.

According to a further embodiment, reversing pulleys for the cable, by means of which the carriage is connected to the piston, are secured to a transverse wall of the sectional rail. This obviously provides a particularly stable and operationally reliable arrangement, especially since, with the front wall removed, the cable is easily accessible for tensioning, adjusting or inspection.

According to another preferred feature, the carriage comprises an intermediate part engaging externally around the rear wall of the sectional rail and two guide elements slidable in the two guide rails. The carriage is thus located mainly behind the front wall. The intermediate part is located between the rear wall and a shower room wall to which the sectional rail is secured. This configuration provides comparatively small structural depth and reliable guidance for the carriage.

The massage and shower heads are, in a preferred form, located laterally of the front wall and of the sectional rail and do not therefore project forwardly beyond the front wall. A massaging and showering assembly of such a type may easily be used, even under cramped conditions, since it requires comparatively little structural depth.

According to one desirable feature, the sectional rail and guiding cylinders are made in one piece. This substantially simplifies production and also ensures high stability.

The sectional rail and guiding cylinders are of substantially trapezoidal cross-section, with the lateral walls arranged at an obtuse angle to the rear wall of the sectional rail. The rear wall is narrower than both the transverse wall and the front wall. This provides a particularly reliable and stable construction which uses little material and is of small structural volume.

It is desirable for the apertures for the guide elements of the carriage to be located in the vicinity of the lateral surfaces or an extension thereof. These apertures are covered and point rearwardly, more particularly toward a room wall, so that the danger of dirt reaching the guide rails is very slight.

In one particularly preferred construction, the piston-cylinder arrangement is located behind the front wall which is connected forwardly to a shower cabin or bath-tub. Located behind the front wall and/or inside the sectional rail are the piston cylinder arrangement, guiding cylinder and a guide element for the carriage. This provides a particularly compact and reliable design with low overall weight.

According to an alternative construction, the cylindrical outer surface of the cylinder may also be used as the guiding cylinder or guide rail, at least partly enclosed by the guide element of the carriage. The said cylinder thus has a dual function, resulting in still further space and weight saving.

According to another configuration, the front wall comprises an aperture through which passes the stem of an adjusting cock for a valve upstream of the piston-cylinder arrangement. This adjusting cock actuates the massaging shower and may, if necessary, be removed forwardly, to allow the front wall to be released from the sectional rail.

In one configuration of the invention, the water line is connected to the massage and shower head directly through an adjusting valve, a check-valve or the like being provided in a collector line which is connected to the piston-cylinder unit. This provides a high degree of operating convenience, since the adjusting valve merely predetermines the volume of water emerging from the massage and shower head, without affecting the rate of adjustment. This results in largely independent adjustment of the volume of water and rate of adjustment. The check valve prevents unwanted feedback effects. Water can emerge from the massage and shower head even when it is stationary, the mains pressure being available practically unchanged and thus making it possible to fit the shower head with a turbine for releasing a pulsating jet of water. The check valve, or the like, ensures that there is no feedback to the piston-cylinder arrangement, even when the valve is closed or the shower head is stationary.

In order to ensure reliable and safe operation, at least one pressure-relief valve is associated with the piston-cylinder arrangement. If the shower head is held stationary, or its freedom of movement is otherwise impeded, an inadmissible increase in pressure in the piston-cylinder arrangement is prevented by this pressure-relief valve. The latter is preferably provided in the piston, resulting in a particularly inexpensive and space-saving arrangement with high operating reliability. The drop in pressure takes place from one chamber of the piston-cylinder to the other, pressure equalization being effected in both directions.

In another configuration, in which the shower head is connected to the piston-cylinder arrangement by a cable, the length of the passages for the cable in the bottom and cover of the cylinder is such that a low water leakage rate is achieved with an adequate pressure-drop. For this purpose, the length is at least twenty, preferably fifty, times the diameter of the cable.

Moreover, according to a further configuration, a narrow annular gap is provided between the cable and the wall of the passage. The diameter of the said passage is preferably between 3/100 and 7/100 mm, preferably between 4/100 and 6/100 mm and better still about 5/100 mm larger than the diameter of the cable. In an annular gap of this kind, a pressure-drop takes place and the cable is practially always in the center of the passage, thus almost eliminating any contact between the cable and the wall-surface.

In one alternative configuration, a magnet is coupled magnetically to the piston of the piston-cylinder arrangement. This magnetic coupling eliminates the need for a passage such as that required for a cable. To this end, an at least partly annular permanent magnet is provided in the vicinity of the outer surface of the piston. Where only one permanent magnet is provided, a corresponding return-circuit ring, or the like, is fitted to the other associated part. The necessary magnetic forces are preselected without any difficulty with such permanent magnets and production and assembly are particularly simple. Finally, the magnetic forces may be preselected in such a manner that, in the event of unskilled handling or overloading, the massage head is separated from the piston, thus avoiding any damage from overloads.

According to yet another feature, a cable connected to the piston passes over reversing rollers and is detachably connected to the guide element of the carriage. If an adjustable force is exceeded, the coupling elements between the guide element and the cable are released automatically.

This is a particularly reliable way of meeting the safety requirement and avoiding damage from overloading, especially in the event of the carriage being stopped. The guide element is preferably in the form of a hollow body in which a coupling element secured to the cable is arranged. Another coupling element of the guide element, which is spring preloaded, acts upon this coupling element. In the event of an overload, the carriage is automatically released from the cable. High operational safety is thus achieved with a simple design.

According to a further embodiment of the invention, the water flow reversing control-unit comprises a control slide valve actuated by the carriage by means of a switch-bar guided by the other guide element of the carriage. Springs are arranged in the hollow guide element, in such a manner as to effect immediate reversing upon reaching a preselectable terminal position. When the carriage reaches the said terminal position, energy is stored by the said springs. The springs are thus preloaded until the retaining or frictional forces are overcome and the reversing control unit can carry out a direct reversal. This eliminates inadmissible dead-centres and ensures that the carriage always moves in one direction or the other and is not left standing in some intermediate position upon reversal. The spring elements, or energy storage means in general, take up no additional space, since optimal use is made of the volume of the guide element. According to one desirable configuration, a fixed partition is arranged in the interior of the guide element, the inner end of a spring bearing upon each side of the said partition. Arranged at the outer end of each spring is a body which is displaceable in relation to both the switch-bar and the guide element.

The switch-bar passes through the guide element, the partition, the springs and the said bodies. Under normal circumstances, the guide element may move freely in relation to the said switch-bar. Arranged upon the switch-bar are sufficiently well-known adjusting elements which are used to restrict movement. If one of the displaceable bodies comes into contact with such an adjusting element, the relevant spring is first of all preloaded, but the switch-bar is not moved. The switch-bar is suddenly actuated only when a retaining force is exceeded, in such a manner that the control valve is also shifted to the required position. Reliable change-over is thus assured at a minimal cost.

According to an additional preferred embodiment, a toothed segment is secured to the control slide valve and engages with a rack on the swtich-bar, thus providing a direct connection between the two at low cost. It is also desirable for a spring-element to be associated with the control slide valve in order to hold the latter in, and/or move it into, one of two terminal positions. This is a simple way of arranging for two-position operation so that, in co-operation with the above-mentioned means for storing energy, immediate and positive change-over is assured under all operating conditions and undesirable intermediate positions are avoided.

Accordingly, the invention is herein broadly claimed as a massaging and showering assembly comprising: an upstanding carriage guiding rail; a carriage having at least one massage and shower head thereon; a water flow reversing control unit; an upstanding cylinder closed at the ends and having a piston therein for slidable reciprocating displacement; a controlled water source operatively connected to said flow reversing control unit; first means connecting said cylinder piston and said carriage to cause vertical reciprocation of said carriage and head along said guiding rail upon reciprocation of said piston; water line means connecting said cylinder at the ends thereof with said water flow reversing control unit; and second means operable by said first means to actuate said control unit thereby causing reversal of water flow in said water line means and consequent reversal of movement of said piston in said cylinder and hence reversal of movement of said carriage and the head thereon and whereby cut off of said controlled water source connected to said control unit causes said piston and said carriage to come to a stop, characterized by the improvement wherein:

said carriage-guiding rail forms an enclosure having a front wall facing in the direction of water spray from said massage and shower head;

said cylinder and piston movable therein are housed within said enclosure behind said front wall;

said carriage is formed with at least one guide element, and said enclosure defines at least one elongated vertical opening through which said guide element extends to guide said carriage along said carriage-guiding rail.

Further advantages and characteristics of the invention will be gathered from the following description of preferred embodiments given in conjunction with the drawing attached hereto, wherein.

DESCRIPTION OF THE PREFERRED EMBODIMENTS

Figure 1:
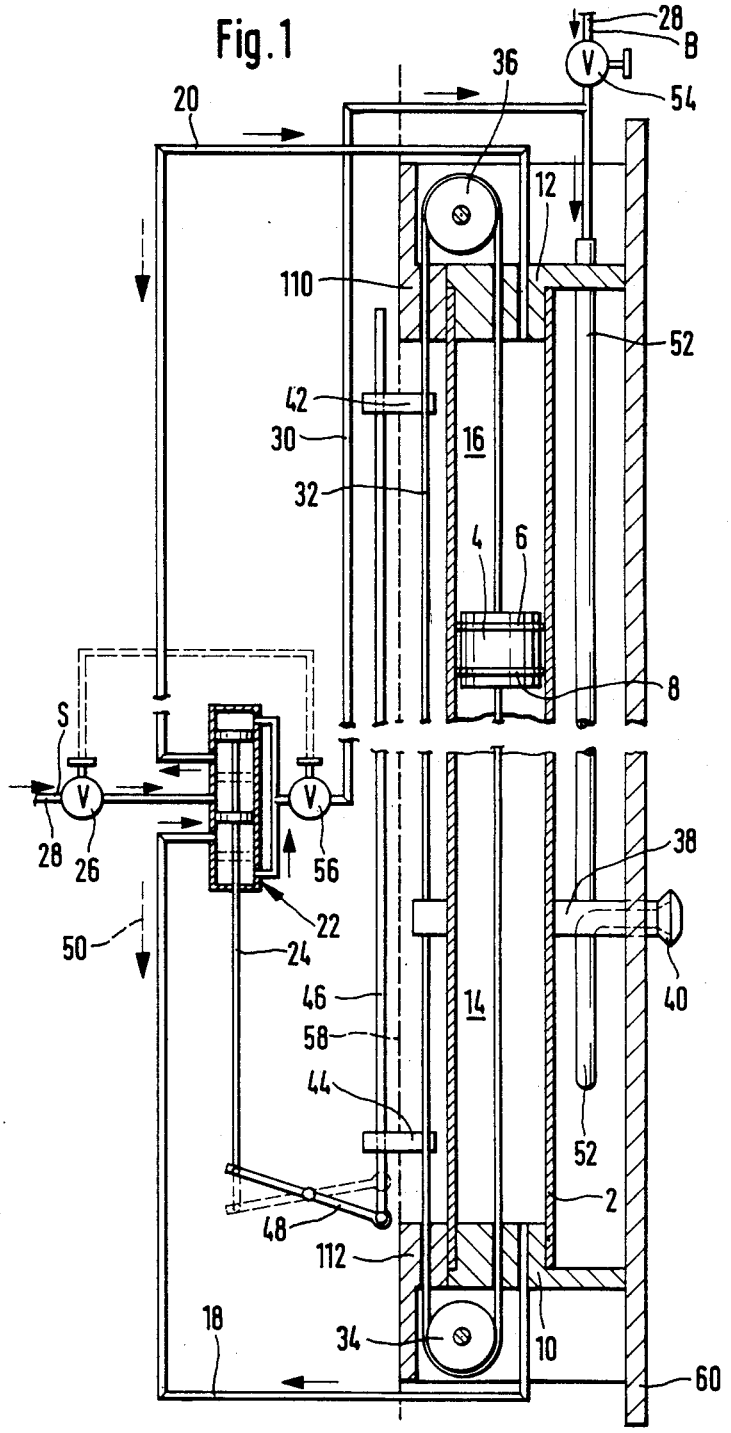
FIG. 1 is a diagrammatical representation of a massaging and showering assembly made according to the invention.

The massaging and showering assembly of FIG. 1 comprises a vertical cylinder 2 in which slides a piston 4. Two seal rings 6, 8 fitted around the outer surface of the piston ensure liquid sealing. Cylinder 2 has a bottom plug 10 and a cover 12, and defines with piston 4, two separate closed chambers 14, 16. Two water lines 18, 20 extend respectively through bottom plug 10 and cover 12 and are connected to a water flow reversing control unit 22 which contains a control slide valve and is connected to a water line 28. With control slide valve 22 in the setting shown in full lines, water flows through line 20 into upper chamber 16, thus moving piston 4 downwardly. Water in chamber 14 then drains away through line 18 and control unit 22 into a collector line 30. It will be appreciated that the rate of adjustment of piston 4 may be preselected according to the setting of valve 26.

A carriage 38 and a massage and shower head 40, mounted thereon, are connected to piston 4 by means of a cable 32 winding around deflecting pulleys 34, 36. Cooperating with carriage 38 is an upper movable stop 42 and a lower movable stop 44 by means of which a switch-bar 46, to which stops 42, 44 are connected may vertically be displaced. Upon downward movement of piston 4, carriage 38 moves upwards by means of cable 32 until it hits stop 42. The latter then moves up, drawing with it bar 46 which pivots lever 48 to have it assume the position shown in dotted lines. The control slide pistons of valve 22 then move down to the setting shown in dotted lines. Water thereafter flows, as indicated by the dotted arrow 50, from the flow reversing control unit 22, through line 18 and into lower chamber 14, causing piston 4 to move up. As to water in chamber 16, it discharges into collector line 30, via line 20.

Water is fed to head 40 through a flexible hose 52 and through an adjusting valve 54 which is also connected to a water line 28. If necessary, however, a mixing valve may be provided to mix cold and hot water in desired proportions. For this reason, the drawing shows no direct connection between the inputs to valve 26 and adjusting valve 54. There is no need to emphasize that the amount of water emerging from head 40 is controlled by the setting of adjusting valve 54. As illustrated, collector line 30 is also connected, upstream of adjusting valve 54, to water hose 52 as seen by the indicated direction of flow. Thus water from the piston-cylinder arrangement 2, 4, which is used to adjust the position of head 40, also feeds into the head 40. Now, in order to prevent the water pressure upstream of adjusting valve 54 from acting on the piston-cylinder arrangement 2, 4 when valve 54 is opened, a check-valve 56 is provided across collector line 30. In the event that valve 26 is closed, causing massage head 40 to remain in a predetermined stationary position, unwanted movements arising from pressure otherwise acting upon the piston-cylinder arrangement are eliminated.

If, for example, adjusting valve 54 is preceded by a mixing valve for hot and cold water, suitably preheated feed water B is then fed, through adjusting valve 54, to the massage and shower head 40. It is expressly pointed out that in such a case only cold control water S could be fed through valve 26 to control unit 22 and piston-cylinder arrangement 2, 4. The piston-cylinder arrangement 2, 4, need therefore be designed only for comparatively slight temperature fluctuations. Thus cylinder 2 may be made of aluminum or plastic, with no problems thereof arising due to changes in length or diameter caused by expansion and contraction. Furthermore, since the feed water coming out of adjusting valve 54 does not act upon the piston-cylinder arrangement, the latter may be designed for correspondingly small amounts of control water S, thus saving a not negligeable amount of money and space. It is obvious that space saved by a compact design of a massaging and showering assembly is of considerable importance in the usually cramped conditions existing in a shower. Connection elements 110, 112 are provided at the top and bottom of cylinder 2 for securing the assembly to a shower wall 58 shown in broken line. It should be pointed out that these connection elements may also be connected directly to a sectional rail 60, thus providing reliable support for the assembly as a whole. Within the scope of the invention, the connection elements may be designed as top and bottom parts which may, if necessary completely close off the sectional rail and also the guide rails at top and bottom.

Broken line 58 indicates a shower wall or the like to which the massaging and showering assembly is secured. Merely for the sake of clarity, the low reversing control unit 22, pivoting lever 48, etc. are shown to the left of line 58 in the drawing, whereas they are actually located to right of the said line and in front of or behind the plane of the drawing. Shown to the right of the drawing is a sectional rail 60, to which the piston-cylinder arrangement 2, 4, the deflecting pulleys 34, 36, and the remaining components are attached in a suitable manner. The sectional rail 60 thus indicated, constitutes, as it were, the housing of the assembly according to the invention and is secured at the top and bottom to the wall indicated by the broken line 58.

Figure 2:
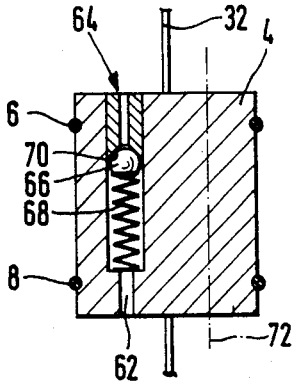
FIG. 2 is a cross-sectional view of the cylinder piston, with a pressure-relief valve.

FIG. 2 is a cross-section, on an enlarged scale, through piston 4 to which cable 32 is connected. Provided on the outer surface of piston 4 are sealing rings 6, 8. The piston also comprises a longitudinal passage 62 with a pressure-relief valve 64. The latter, shown diagrammatically only, contains a closure element 66 in the form of a ball which is pressed upon a valve seat 70 by a spring 68. If pressure in chamber 16 above piston 4 exceeds a value predetermined by this pressure-relief valve, the latter opens. This greatly increases the operational and functional safety of the assembly, since any excess pressure is simply relieved into the other chamber 14 and the latter is in communication with the exterior through the collector line 30 and the massage head 40. As indicated simply by broken line 72, piston 4 has another longitudinal passage likewise containing a pressure-relief valve, not shown, acting in the opposite direction. Obviously, a single double-acting pressure-relief valve could also be used.

Figure 3:
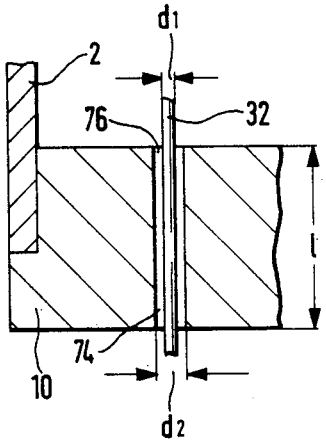
FIG. 3 is a partial enlarged cross-sectional view of the bottom of a cylinder, with a passage for a cable.

FIG. 3 shows, on an enlarged scale, a passage 74 in the form of a bore through bottom plug 10 of cylinder 2. d 1 is the diameter of cable 32 while d 2 is the diameter of passage 74, but for greater clarity these diameters are not drawn to scale. Diameter d 2 of passage 74 is between 3/100 and 7/100 mm greater than diameter d 1 of the cable. Length 1 of the said passage is at least 10 times, preferably 20 times, greater than diameter d 1 of cable 32. The aforesaid dimensions ensure a relatively low rate of water leakage, the drop in pressure taking place over length 1. It is of particular importance in this connection that cable 32 not rub, in practice, against the wall of passage 74 but that it be guided by a pressure cushion in a narrow annular gap 76 approximately centrally of passage 74.

Figure 4:
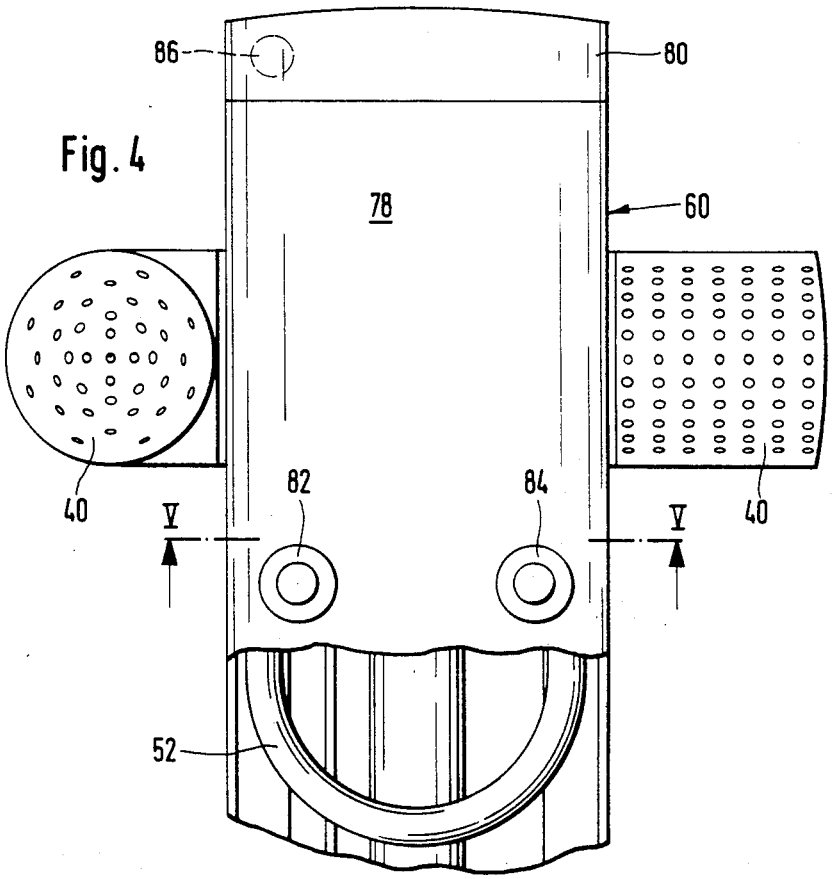
FIG. 4 is a partial front elevation view of an embodiment comprising two laterally arranged massage and shower heads.

In the embodiment of FIG. 4, a massage and shower head 40 is provided on each side of sectional rail 60, the latter having a closed front wall 78 and being closed off at the top by means of an end cap 80 to form an enclosure. Located at the front wall 78 of the rail 60 are adjusting cocks 82, 84 for the above-mentioned valve 26 and for the valve 54. The cocks are preferably located at a suitable distance above the lower end, not shown, of the sectional rail 60 so that they may be easily accessible to an adult. Located behind front wall 78, within the enclosure defined by sectional rail 60, is the water hose 52 through which water passes to feed the heads 40. Located at the upper end of sectional rail 60 is a connection 86 for the water line, not shown. As may also be gathered from FIG. 4, water hose 52 is always suspended within sectional rail 60 in a manner such as to form a kind of loop at the bottom. As explained hereinafter, kinks in the water hose 52 are prevented by suitably guiding it in channels.

Figure 5:
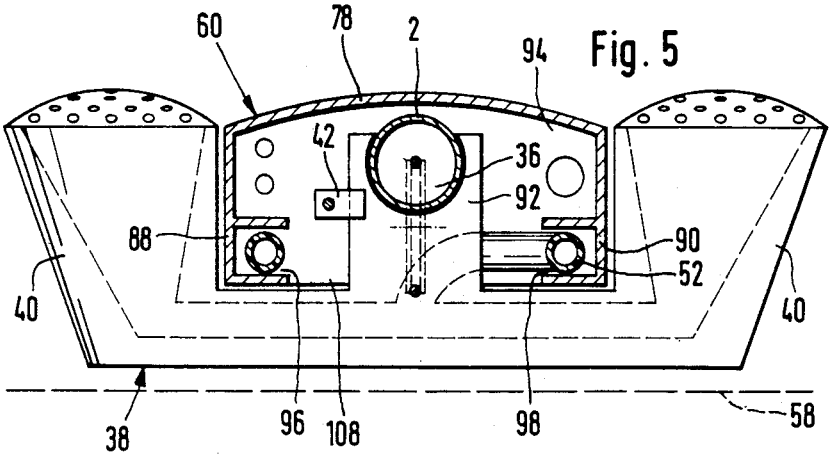
FIG. 5 is a cross-section along line V—V in FIG. 4.

FIG. 5 is a cross-section along line V—V of FIG. 4, showing the large enclosure defined by sectional rail 60, comprising the closed front wall 78 adjoining lateral walls 88, 90. Broken line 58 again indicates the shower wall to which sectional rail 60 is secured at its upper and lower ends in a suitable manner. Of special significance is the fact that carriage 38 is arranged, as it were, behind the said sectional rail 60, between it and shower wall 58. A guide element 92 formed with carriage 38 enters into the enclosure or inner chamber 94 of sectional rail 60, through a rear opening 108 thereof running along its longitudinal direction.

The guide element 92 partly surrounds cylinder 2, represented here only diagrammatically, cylinder 2 thus constituting a guide member for the carriage 38 and the heads 40. Also located in chamber 94 are two channels 96, 98, facing one another upon lateral walls 88, 90. These channels serve to guide and accommodate the water hose 52, the right-hand end of the hose, shown here, being connected to the carriage 38 to supply water to the carriage and thence to massage and shower head 40. The other end of hose 52, shown at the left, lies in channel 96 and is coupled to the above-mentioned water connection 86. Also shown in the inner chamber 94 of sectional rail 60 is the upper stop 42 and reversing pulley 36 for the cable. The massaging and showering assembly thus described is of extremely simple and compact design, all of the essential components being arranged in the hollow sectional rail 60. Above all, the mounting of the guide rail cylinder 2, guide element 92 and water hose 52 in the chamber 94 ensures operating reliability, since it practically eliminates dirt and damage. Apart from this, closing off the front wall of the sectional rail, resulting in a closed front surface, provides a particularly attractive assembly which is also easy to clean.

Figure 6:
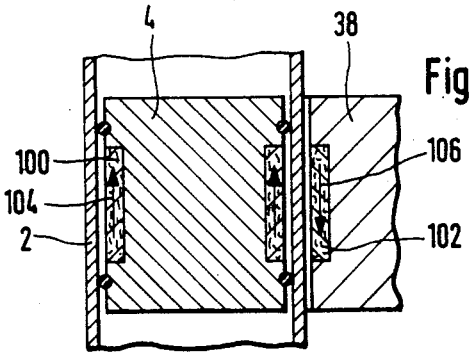
FIG. 6 is a partial cross-sectional view of a magnetic coupling for the carriage.

FIG. 6 illustrates a preferred embodiment wherein carriage 38 is coupled magnetically to piston 4. To this end, piston 4 carries along its outer surface an annular permanent magnet 100 which is magnetized in the longitudinal direction. A corresponding permanent magnet 102 is fixed to carriage 38, but this magnet is magnetized in the opposite direction, as shown by arrows 104 and 106. This construction eliminates the aforesaid cable passages through the bottom and cover of the cylinder, and the difficulties and conditions associated therewith. In this case, piston 4 may also comprise pressure-relief valves, not shown.

Figure 7:
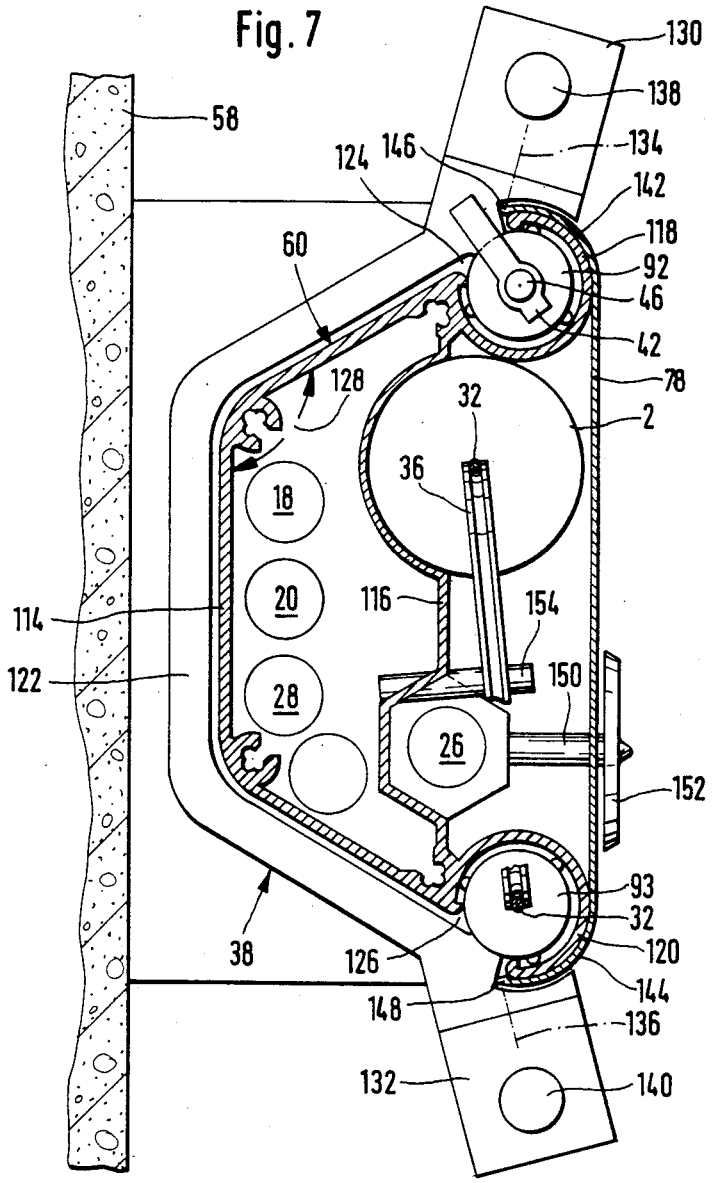
FIG. 7 is a cross-section through a carriage and a carriage guiding sectional rail with removable front wall.

FIG. 7 illustrates another configuration of the massaging and showering assembly according to the invention. Sectional rail 60 is of substantially trapezoidal cross-section, rear wall 114 being the shortest. Arranged in the inner chamber of the sectional rail 60 is a transverse wall 116 on which cylinder 2 is mounted. Cylinder 2 may be connected directly to transverse wall 116 or else to the previously mentioned connection elements. Located at the two front corners of rail 60 are two hollow, guide rails 118, 120 also called guiding cylinders, in which guide elements 92, 93 are displaceable in the longitudinal vertical direction of the sectional rail 60, i.e. at right angles to the plane of the drawing. In this case, carriage 38 has a central part 122 located between rear wall 114 of sectional rail 60 and the shower wall 58. Apertures 124, 126 through the guiding cylinders 118, 120, face, as do lateral walls 88, 90, rearwardly towards the shower-wall 58, and the danger of contamination is therefore relatively slight. Lateral walls 88, 90 extend at an obtuse angle 128 with respect to rear wall 114.

Located laterally of the sectional rail 60 and guide cylinders 118, 120, are two holders 130, 132 for the massage and shower heads, not shown, the said holders being adapted to rotate about axes 134, 136, to allow the heads fitted to pins 138, 140 to be pivoted to the desired position. Friction exists between holders 130, 132 and the carriage 38, a suitable preload being provided by means of spring-elements or the like. A front closure wall, 78 in this case,is in the form of a substantially flat plate or sectional rail with lateral rearwardly bent edges 142, 144 whereby the front wall 78 may be clipped on the cylindrical outer surfaces of the guiding cylinders 118, 120 being secured by catches 146, 148 at the edges. This provides a simple and neat snap-on connection between the front closure wall 78 and the guiding cylinders 118, 120. This snap-on connection is easily released, thus allowing front closure wall 78 to be removed very easily. Valve 26 is shown here diagrammatically, being secured to front transverse wall 116 of the sectional rail 60. Its connection to outer adjusting cock 152 is through a stem 150, front wall 78 being provided with a corresponding suitable opening therefor. The adjusting cock 152 may easily be removed from the stem and the valve, allowing front wall 78 to be moved forward. The shaft 154 of the upper reversing pulley 36 (partially cut-off) is also connected to transverse wall 116 and the same applies to the other reversing pulley. Passing over the reversing pulley 36 is cable 32 which, on the one hand, communicates with cylinder 2 and the piston therein and, on the other hand, runs in guiding cylinder 120 where it is connected to guide-element 93 of the carriage 38. Switch-bar 46 and upper stop 42 may be seen in the other guiding cylinder 118, within guide-element 92. Lines 18, 20, in the form of water hoses, and supply line 28 are shown diagrammatically in inner chamber of rail 60 between rear wall 114 and transverse wall 116.

Figure 8:
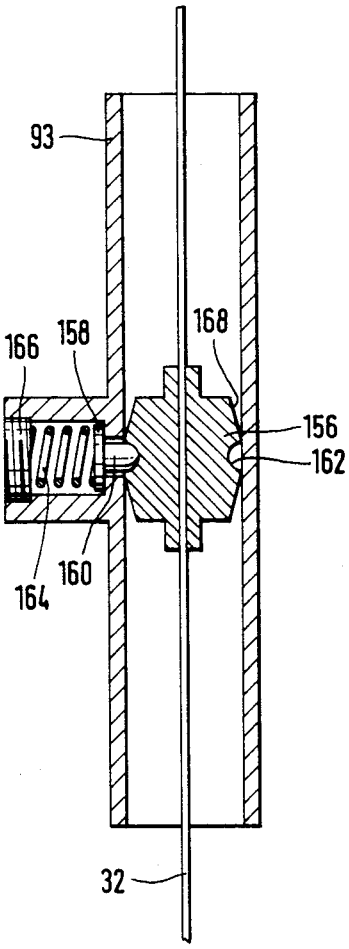
FIG. 8 is a diagrammatic cross-sectional representation of a detachable coupling element between the cable and the carriage.

FIG. 8 is a cross-section of a guide-element 93 which, in this case, is constructed as a cylindrical, hollow body. Located within element 93 is the cable 32, to which a coupling element 156 is secured. The guide-element 93 also comprises a coupling element 158 having a cam 160 suitable to move in an annular groove 162 of coupling element 156, a suitable bias being provided by a spring 164, the strength of said bias being adjustable by means of a screw 166. If a predetermined force is exceeded, as a result of the carriage 38 being halted, cam 160 disengages and guide element 93 and carriage 38, are then disconnected from the cable. Coupling element 156, secured to cable 32, has conical outer surfaces 168 which facilitate coupling to a not negligeable extent.

Figure 9:
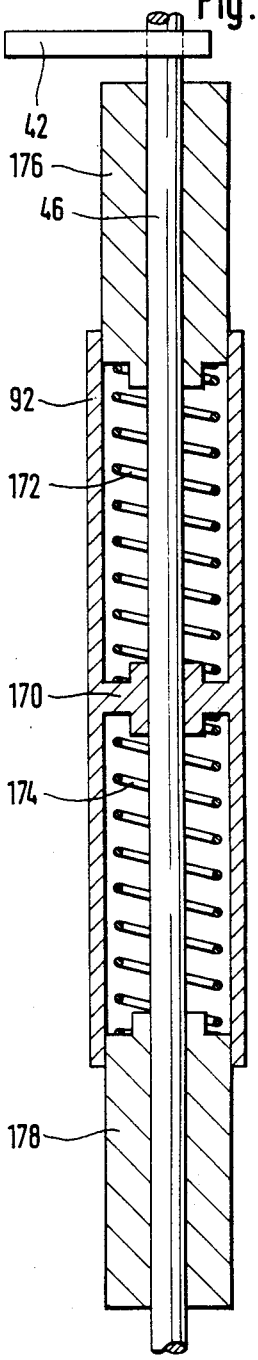
FIG. 9 is a diagrammatic cross-sectional representation of an energy-storage means coupled to the carriage for actuation of the switch-bar.

FIG. 9 illustrates the other guide element 92 which is also in the form of a hollow body. Switch bar 46 passes through element 92 which also comprises a partition 170. Provided inside element 92, on each side of partition 170, are springs 172, 174 with cylindrical elements 176, 178 resting upon the outer ends of the springs 172, 174, the said cylindrical elements 176, 178 being displaceable is relation to both the switch bar 46 and the guide element 92. For example, if, during an upward movement of the carriage 38, element 176 reaches stop 42 secured to switch bar 46, the element 176 is forced into guide element 92 and spring 172 is loaded until the frictional, retaining, and other forces are overcome, whereupon the switch-bar 46 is switched over or moved completely and immediately.

Figure 10:
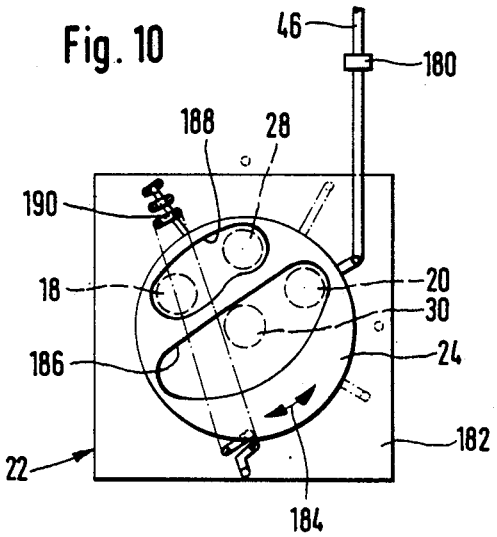
FIG. 10 is a diagrammatic view of a control device.

FIG. 10 illustrates an embodiment wherein the flow reversing control unit 22 has a control slide-valve which is in the form of a rotary piston 24. Switch-bar 46 is hinged to rotating piston 24 through a flexible rubber-metal element 180. The control-unit 22 comprises a housing 182 upon the back of which are arranged the water lines, not visible, but indicated by dotted lines and explained hereinafter. Collector line 30 is located at the centre, while water line 28 is connected radially outwardly. Water lines 18 and 20 enter on each side of line 28 and run to the chambers 14, 16 of the piston-cylinder arrangement. Piston 24, which rotates in the direction of arrow 184, is formed with grooves 186, 188 on its end-face. The desired connection between the different lines is set up in accordance with the position of rotary piston 24. The housing comprises ducts associated with the said lines and these open into a surface facing sealingly the end face of the said piston.

Also provided is a spring 190, the lower end of which communicates with housing 182 while the upper end communicates with rotating piston 24. This spring 190 holds the rotary piston 24 in, or moves it into, its respective terminal position. For instance, if piston 24 is rotated, by means of switch-bar 46, into the other terminal position, the spring-element is first of all biassed and, after passing over centre, it pulls the said piston into the other terminal position. A certain holding force is thus preselected and this is matched by the energy stored by the springs as explained hereinbefore in connection with FIG. 9. This combination ensures a reliable change-over at all times.

Figure 11:
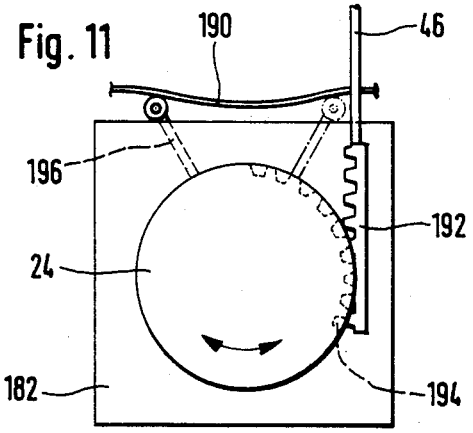
FIG. 11 is an alternative control device construction connected to the switch-bar by means of a toothed segment.

In the embodiment according to FIG. 11, switch bar 46 is coupled to rotating piston 24 by means of a rack 192 engaging with a toothed segment 194 secured to the said rotating piston 24. Also associated with the said piston is a spring-element 190 which, in this case, is in the form of a leaf spring connected to housing 182 in a suitable manner, one end of an arm 196, connected to rotating piston 24, bearing upon the leaf spring 190. The leaf spring 190 is designed in such a manner that when piston 24 rotates out of one terminal position into the other, a certain holding force or preload must first be overcome. After a certain angle of rotation, the piston is rotated with greater force into the other terminal position. The two terminal positions are therefore specifically preselected and this, especially in conjunction with the storage of energy described above, ensures a particularly reliable change-over.

I claim:

1. A massaging and showering assembly comprising:

an upstanding guide rail;

a carriage movable upwardly and downwardly along said guide rail;

means for mounting at least one shower head on said carriage; and means for reversably driving said carriage to cause said carriage to reciprocate upward and downward along said guide rail, said driving means being driven by water supplied to a shower head on said carriage;

wherein said guide rail forms at least part of an enclosure shaving a closed front wall facing in the direction of water spray from a shower head mounted on said carriage, said driving means comprises a piston and cylinder arrangement mounted on a transverse wall within said enclosure behind said front wall, said front wall is releasably secured to the rest of said guide rail and can be removed without disturbing said carriage to provide access to said driving means, said carriage is disposed at least substantially entirely behind said front wall and extends around the back of said guide rail, and the handle of a control valve for regulating the supply of water to said driving means is arranged on said front wall above the bottom of said guide rail.

2. A massaging and showering assembly according to claim 1, wherein said front wall comprises rearwardly curved lateral edges extending releasably around the front corners of the rest of said guide rail.

3. A massaging and showering assembly according to claim 1, wherein said carriage is disposed in an intermediate space between said guide rail and a wall on which said guide rail is mounted, said carriage is provided with at least one guide element extending through a vertical slot into engagement with a track in said guide rail, and said vertical slot is arranged in a portion of said guide rail behind said front wall.

4. A massaging and showering assembly as recited in claim 3, wherein said vertical slot is arranged in a side wall of said guide rail.

5. A massaging and showering assembly according to claim 3, wherein said carriage is formed with two cylindrical guide elements received through slots in the side walls of said guide rail in cylindrical guide tracks formed at the sides of said guide rail.

6. A massaging and showering assembly comprising:

an upstanding guide rail having a substantially trapezoidal cross-sectional configuration in which the front of the guide rail is wider than the back thereof;

a carriage movable upwardly and downwardly along said guide rail;

means for mounting at least one shower head on said carriage;

means for reversably driving said carriage to cause said carriage to reciprocate upward and downward along said guide rail, said driving means being driven by water supplied to a shower head mounted on said carriage;

wherein said guide rail forms an enclosure having a closed front wall facing in the direction of water spray from a shower head mounted on said carriage, said driving means are housed within said enclosure behind said front wall, said front wall is releasably secured to the rest of said guide rail and can be removed without disturbing said carriage to provide access to said driving means, and said carriage has a substantially U-form extending around the back of said guide rail and open toward the front of said guide rail.

7. A massaging and showering assembly according to claim 6, wherein said carriage is provided with at least one guide element extending through a vertical slot in said guide rail into engagement with a track formed in said guide rail, and said vertical slot faces away from said front wall.

* * * * *